United States Patent [19]

Yamamoto

[11] Patent Number: 5,029,737

[45] Date of Patent: Jul. 9, 1991

[54] ICE DELIVERY MECHANISM IN STORAGE BIN-TYPE ICE DISPENSER

[75] Inventor: Jiro Yamamoto, Toyoake, Japan

[73] Assignee: Hoshizaki Denki Kabushiki Kaisha, Toyoake, Japan

[21] Appl. No.: 551,833

[22] Filed: Jul. 12, 1990

[30] Foreign Application Priority Data

Jul. 13, 1989 [JP] Japan ..... 1-82589[U]

[51] Int. Cl.[5] ..... F25C 5/18

[52] U.S. Cl. ..... 222/526; 62/344; 222/146.6; 222/239

[58] Field of Search ..... 62/344; 222/146.6, 491, 222/500, 504, 526, 533, 536, 537, 239; 221/312 R; 194/349

[56] References Cited

U.S. PATENT DOCUMENTS

| | | | |
|---|---|---|---|
| 2,668,648 | 2/1954 | Carlsen | 222/536 X |
| 3,210,019 | 10/1965 | Wakeman | 222/491 X |
| 3,718,237 | 2/1973 | Gittelson et al. | 222/505 |
| 4,102,660 | 7/1978 | Beckett et al. | 62/344 |
| 4,122,932 | 10/1978 | Neubert et al. | 222/526 X |
| 4,209,999 | 7/1980 | Falk et al. | 62/344 |
| 4,220,266 | 9/1980 | Braden et al. | 62/344 X |
| 4,227,383 | 10/1980 | Horvay | 62/344 |
| 4,228,923 | 10/1980 | Barnard | 62/344 X |
| 4,252,002 | 2/1981 | Mullins | 62/344 |
| 4,676,405 | 6/1987 | Lents et al. | 222/146.6 X |

*Primary Examiner*—William E. Tapolcai

*Attorney, Agent, or Firm*—Armstrong, Nikaido, Marmelstein, Kubovcik, & Murray

[57] ABSTRACT

In a storage bin-type ice dispenser, an ice delivery mechanism includes a tubular delivery chute coupled with a dispensing opening of a storage bin and extending downward and outward from a front wall of the bin. A vertical discharge duct is detachably mounted to a lower portion of the front wall of the bin and is located just below a lower opening end of the delivery chute to receive ice cubes discharged therefrom. A balance shutter is tiltably mounted on an upper end of the discharge duct in a detachable manner and extends downward into the interior of the discharge duct for engagement with an internal wall surface of the duct when maintained in a closed position. A weight element is detachably assembled with an outwardly extended portion of the balance shutter to maintain the balance shutter in the closed position by its weight. The balance shutter is opened by gravity acting on the weight element when the ice cubes from the delivery chute are received thereon.

6 Claims, 3 Drawing Sheets

ICE DELIVERY MECHANISM IN STORAGE BIN-TYPE ICE DISPENSER

BACKGROUND OF THE INVENTION

1. Field of the Invention

The present invention relates to a storage bin-type ice dispenser, and more particularly to an ice delivery mechanism in the dispenser.

2. Discussion of the Prior Art

Japanese Utility Model Publication No. 60-29031 proposes a storage bin-type ice dispenser which includes a storage bin arranged to store therein a large amount of ice cubes. A feed screw is rotatably mounted within the storage bin. A weighing box is placed just below a dispensing opening of the storage bin to store therein the ice cubes discharged by rotation of the feed screw. A movable receiver plate is arranged to close the bottom of the weighing box for receiving the ice cubes thereon. An inclined tiltable partition plate is arranged just below the weighing box to be opened when the ice cubes received thereon are dropped from the receiver plate and to be closed by gravity of a weight provided thereon. When a predetermined amount of ice cubes are received, the receiver plate is moved to drop the ice cubes therefrom, and in turn, the partition plate is opened by gravity of the weight to drop the ice cubes therefrom into a prepared take-out cup. After the ice cubes are dropped, the partition plate is closed by gravity of the weight.

In such an ice delivery mechanism as described, the weighing box, receiver plate and partition plate cannot be disassembled. It is, therefore, very difficult to clean the component parts of the delivery mechanism when they have been stained. If the bottom surface of the partition plate is wet with water, the partition plate will not be closed due to adherence to an internal surface of its support wall after being opened to drop the ice cubes into the take-out cup. In such a condition, a user may operate the component parts of the delivery mechanism in an unauthorized manner.

SUMMARY OF THE INVENTION

A primary object of the present invention is to provide an improved ice delivery mechanism in which the component parts can be disassembled in a simple manner for cleaning thereof.

A secondary object of the present invention is to provide an ice delivery mechanism wherein a balance shutter in a discharge duct is smoothly closed even if it is wet with water at its bottom surface.

According to the present invention, the primary object is attained by providing an ice delivery mechanism which includes a tubular delivery chute coupled within a dispensing opening of the storage bin and extends downward and outward from the front wall of the storage bin. A vertical discharge duct is detachably mounted to a lower portion of the front wall of the bin and is located just below a lower opening of the delivery chute to receive the ice cubes discharged therefrom. A balance shutter is tiltably mounted on an upper end of the discharge duct in a detachable manner and extends downward into the interior of the discharge duct for engagement with an internal wall surface of the duct when maintained in a closed position. A weight element is detachably assembled with an outwardly extended portion of the balance shutter to maintain the balance shutter in the closed position by its weight. The balance shutter is opened by gravity acting on the weight element when the ice cubes from the delivery chute are received thereon.

To attain the secondary object of the present invention, the balance shutter is provided at a bottom surface thereof with a projection for engagement with an internal wall surface of the discharge duct. In a practical embodiment of the present invention, it is preferable that the discharge duct is detachably mounted to the lower portion of the front wall in such a manner as a) to be vertically positioned in parallel with the front wall where the weight element has been assembled with the outer end portion of the balance shutter and b) to be inclined forward when mounted to the front wall without the balance shutter or the weight element. An interlock switch is mounted to the lower portion of the front wall to be closed by engagement with the discharge duct for permitting power to be supplied to an electric motor in a drive mechanism of the agitator and to be opened for prohibiting the power to be supplied to the electric motor when the discharge duct has been inclined forwardly.

BRIEF DESCRIPTION OF THE DRAWINGS

Additional objects, features and advantages of the present invention will be readily appreciated from the following detailed description of a preferred embodiment thereof when taken together with the accompanying drawings, in which.

DESCRIPTION OF THE PREFERRED EMBODIMENTS

Figure 1:
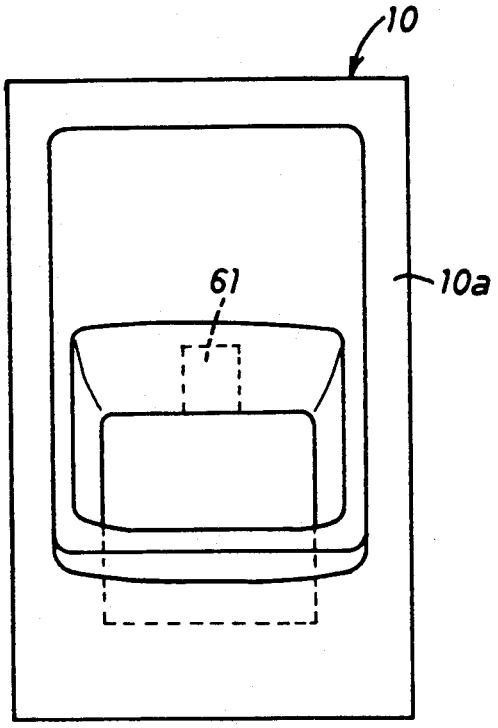
FIG. 1 is a front view of a storage bin-type ice dispenser.
Figure 2:
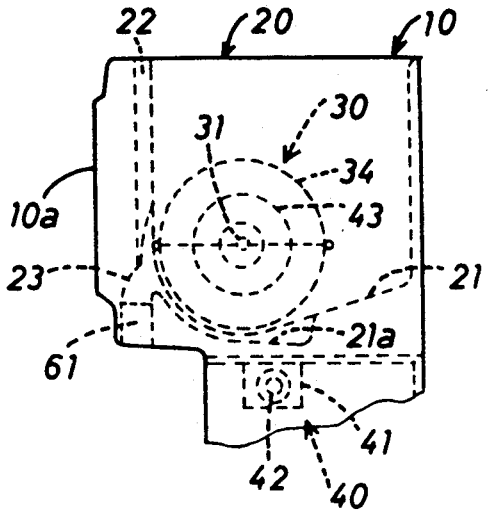
FIG. 2 is a side view of an upper portion of the ice dispenser.
Figure 3:
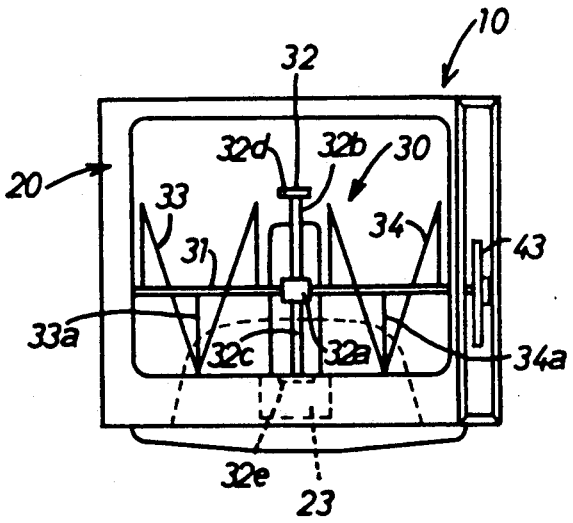
FIG. 3 is a plan view of the upper portion of the ice dispenser.

In FIGS. 1–3 of the drawings, there is schematically illustrated a storage bin-type ice dispenser which includes an ice storage bin 20 installed within an upper portion of a box-type cabinet 10 to store a large amount of ice cubes. As shown in FIGS. 2 and 3, the ice storage bin 20 is provided therein with an agitator 30 which includes a rotary shaft 31 rotatably supported on a pair of opposed side walls of bin 20. A finger assembly 32 is mounted on the center of rotary shaft 31. A pair of axially opposed helical wire augers 33, 34 is also provided. The rotary shaft 31 is positioned in parallel with a semicylindrical internal wall surface of bin 20 in such a manner that the axis of shaft 31 coincides with the center of a semicircle defined by the bottom surface of a guide groove 21*a*. The guide groove 21*a* is located at the central portion of an internal bottom wall 21 of bin 20 in a lateral direction and extends upward from the bottom wall 21 to a lower part of the front wall 22 of bin 20.

The finger assembly 32 includes a hub sleeve 32*a* secured to the center of shaft 31, a pair of radially extending support arms 32*b*, 32*c* welded at their inner ends to the hub sleeve 32*a*, and a pair of lateral fingers 32*d*, 32*e* welded to the distal ends of support arms 32*b*, 32*c*, respectively in a T-letter form. The length of arms 32*b*, 32*c* and width of fingers 32*d*, 32*e* are determined to allow rotary motion of the fingers 32*d*, 32*e* along the bottom of guide groove 21*a* during rotation of shaft 31. The helical wire augers 33, 34 are provided respectively on the left-hand and right-hand portions of shaft 31. The left-hand wire auger 33 has inner and outer rod portions which are welded at their inner ends to the rotary shaft 31 to extend radially in parallel therefrom. An intermediate portion of wire auger 33 is supported by a radial rod 33*a* which is welded at its inner end to the rotary shaft 31.

The right-hand wire auger 34 has inner and outer rod portions which are welded at their inner ends to the rotary shaft 31 to extend radially in parallel therefrom. An intermediate portion of wire auger 34 is supported by a radial rod 34*a* which is welded at its inner end to the rotary shaft 31. The wire augers 33, 34 are formed in a reverse pitch to push the ice cubes toward the center of shaft 31 from the side walls of bin 20 during rotation of shaft 31. A drive mechanism 40 of the agitator 30 includes an electric geared motor 41 attached to an external bottom wall of bin 20, a drive sprocket 42 mounted on an output shaft of geared motor 41, and a driven sprocket 43 fixed to an outer end of rotary shaft 31. The driven sprocket 43 is drivingly connected to the drive sprocket 42 by means of a drive chain (not shown).

Figure 5:
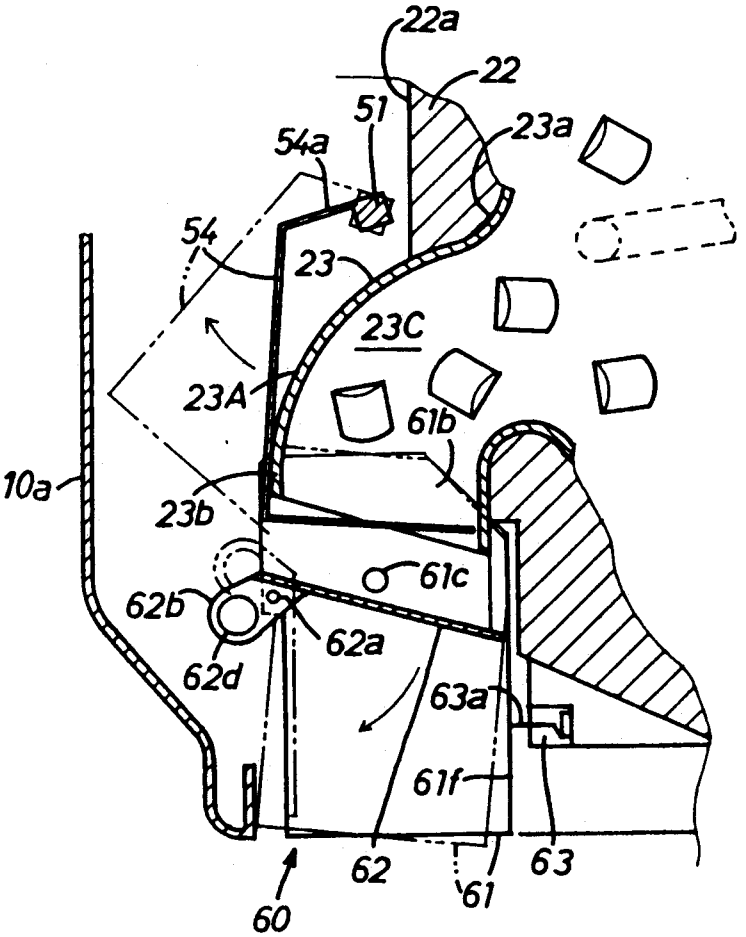
FIG. 5 is a vertical sectional view of the ice delivery mechanism shown in FIG. 4.
Figure 4:
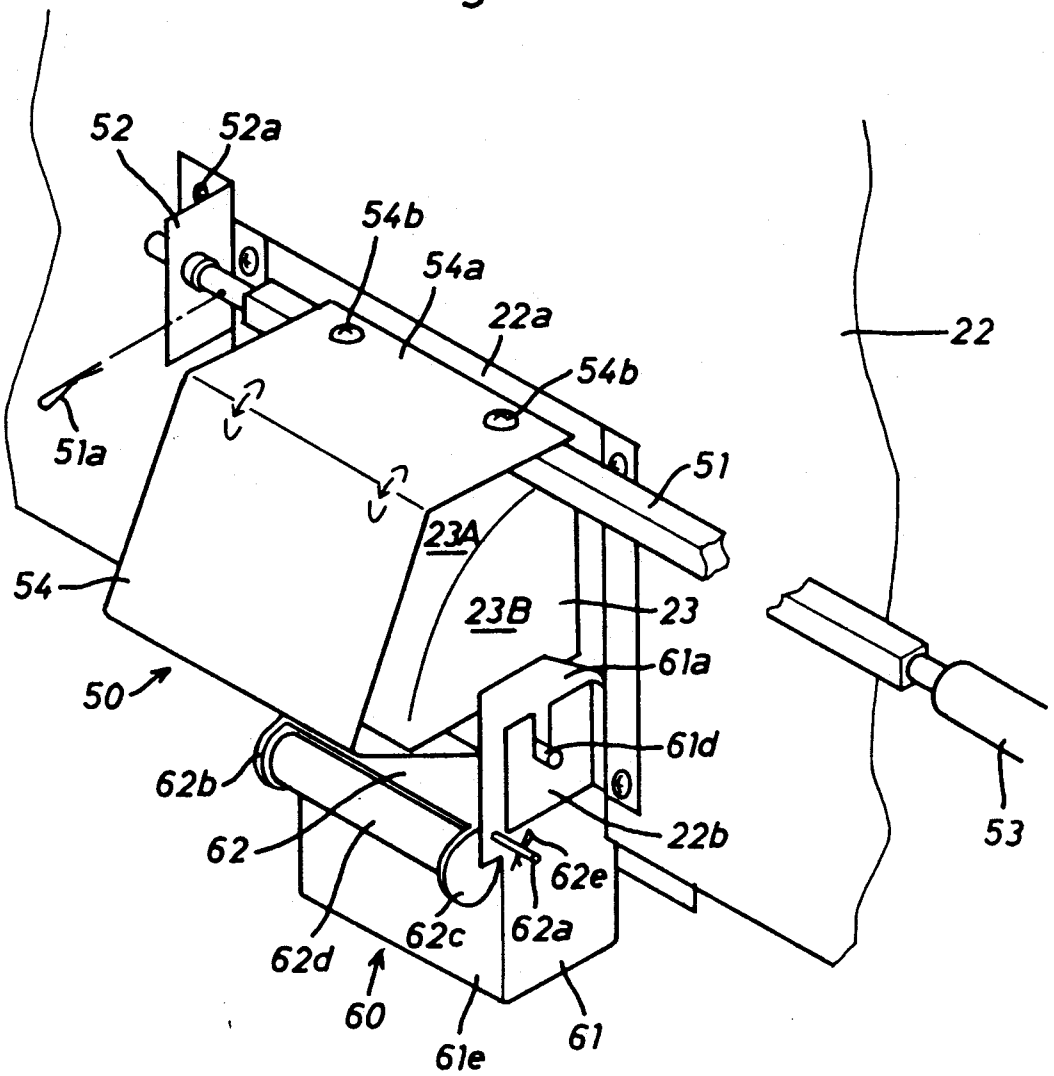
FIG. 4 is an enlarged perspective view of an ice delivery mechanism in accordance with the present invention.

As shown in FIGS. 2 and 5, the front wall 22 of bin 20 is provided at its lower portion with a tubular delivery chute 23 extending downwardly and outwardly therefrom. The delivery chute 23 is expanded in cross-section from its neck portion 23*a* to its lower opening end 23*b* and has a semicylindrical upper wall 23A and a pair of parallel side walls 23B and 23C. As shown in FIG. 4, a shutter mechanism 50 of the delivery chute 23 includes a rotary shaft 51 which is located horizontally above the delivery chute 23. The rotary shaft 51 has one end rotatably supported on the front wall 22 of bin 20 by means of a bracket 52 and the other end is detachably connected to an output shaft 53 of a solenoid actuator (not shown). The bracket 52 is secured to the front wall 22 of bin 20 by means of screws 52*a*, and the rotary shaft 51 is retained in place by means of a pin 51*a* inserted therethrough. The shutter mechanism 50 further includes a shutter 54 secured at its base end 54*a* to an upper surface of rotary shaft 51 by means of screws 54*b*, 54*b*. As shown in FIGS. 4 and 5, the shutter 54 is formed to cover the upper wall 23A and opening end 23*b* of delivery chute 23. When the rotary shaft 51 is rotated clockwise by activation of the solenoid actuator, the shutter 54 is moved upward and retained at a position indicated by the broken lines in FIG. 5 to open the opening end 23*b* of delivery chute 23. When the rotary shaft 51 is rotated counterclockwise by activation of the solenoid actuator, the shutter 54 is moved downward and retained at a position indicated by the solid lines in FIG. 5 to close the opening end 23*b* of delivery chute 23.

As shown in FIG. 5, an ice discharge mechanism 60 of the ice dispenser is arranged just below the opening end 23*b* of delivery chute 23 and assembled with the front wall 22 of bin 20 through a mounting plate 22*a*. The ice discharge mechanism 60 includes a vertical discharge duct 61, a balance shutter 62 and a normally closed interlock switch 63. The discharge duct 61 is formed rectangular in cross section and has a pair of opposed side flanges 61*a*, 61*b* which are supported in place by means of lateral pins 61*c*, 61*d* respectively secured thereto and rotatably coupled within each vertical recess of support flanges 22*b*, 22*c* extending perpendicularly from the mounting plate 22*a*. In such an arrangement, the lateral pins 61*c*, 61*d* of side flanges 61*a*, 61*b* are located in a position displaced rearwardly at a slight distance from the center of gravity of the discharge duct 61.

The balance shutter 62 is in the form of a flat plate made of synthetic resin and is tiltably supported at its base portion on the side flanges 61*a*, 61*b* of discharge duct 61 by means of a lateral support rod 62*a*. The lateral support rod 62*a* is arranged just above the upper end of a front wall 61*e* of discharge duct 61 and is carried by the side flanges 61*a*, 61*b* of discharge duct 61. The lateral support rod 62*a* is retained in place by means of a pin 62*e* inserted therethrough. Thus, the balance shutter 62 is located just below the opening end 23*b* of delivery chute 23 and is inclined downward toward the interior of discharge duct 61. The balance shutter 62 is integrally formed at its base portion with a pair of axially spaced arms 62*b*, 62*c* which are extended forward and downward to support thereon a weight element 62*d* in the form of a bar in parallel with the lateral support rod 62*a*. The weight element 62*d* is detachably supported by the arms 62*b*, 62*c* of the balance shutter 62. The mass of weight element 62*d* is determined to retain the discharge duct 61 vertically where the balance shutter 62 is positioned to close the discharge duct 61 as shown by the solid lines in FIG. 5. When some of the ice cubes drop from the delivery chute 23, the balance shutter 62 receives the ice cubes thereon and is moved downward by the weight of the ice cubes against the weight element 62*d* to open the discharge duct 61 as shown by the broken lines in FIG. 5. In this instance, the discharge duct 61 is vertically retained in place without any tilt since the lateral support rod 62*a* of shutter 62 is located just above and in parallel with the upper end of front wall 61*e* of duct 61.

The interlock switch 63 is mounted to the bottom portion of front wall 22 of bin 20 at a position adjacent a rear wall 61*f* of the discharge duct 61. In a condition where the discharge duct 61 is positioned as shown by the solid lines in FIG. 5, the interlock switch 63 is closed by an actuator rod 63*a* in engagement with the rear wall 61*f* of the discharge duct 61. When the discharge duct 61 is inclined forward as shown by the broken lines in FIG. 5, the interlock switch 63 is opened by return action of the actuator rod 63*a*. The interlock switch 63 is connected in series with an electric power source of the geared motor 41 to permit the supply of electric power to the geared motor 41 when it is being closed. In addition, the shutter mechanism 50 and ice discharge mechanism 60 are covered by a front panel 10*a* which is detachably mounted to the front wall 22 of bin 20 as shown in FIGS. 1 and 2.

Assuming that the interlock switch 63 is closed in a condition where the discharge duct 61 and balance shutter 62 are positioned as shown by the solid lines in FIG. 5, the solenoid actuator is activated to open the shutter 54, and the geared motor 41 is activated by the electric power supplied thereto through the interlock switch 63 to rotate the agitator 30 in the storage bin 20.

Thus, the wire augers 33, 34 agitate the ice cubes stored in the storage bin 20 and push them toward the center of rotary shaft 31 from the side walls of bin 20. The ice cubes pushed by wire augers 33, 34 drop into the guide groove 21*a* and are successively picked up by the lateral fingers 32*d*, 32*e* of assembly 32 along the guide groove 21*a* to drop into the delivery chute 23. In turn, the ice cubes drop on the balance shutter 62 from the opening end 23*b* of delivery chute 23 and cause the balance shutter 62 to open downward against the weight element 62*d*. This causes the ice cubes to successively drop into a prepared cup (not shown) placed below the discharge duct 61. After discharge of the ice cubes into the prepared cup, the balance shutter 62 is quickly returned upward due to gravity acting on weight element 62*d* to close the discharge duct 61 as shown by the solid lines in FIG. 5.

In a condition where the discharge duct 61 is being closed, the balance shutter 62 is retained in a downwardly inclined position by engagement with an internal wall surface of discharge duct 61. Thus, a user cannot open the balance shutter 62 even if the user's hand is inserted into the discharge duct 61 from its lower opening. This means that the delivery chute 23 is isolated from the user's hand which may be inserted into the discharge duct 61 in an unauthorized manner. When the balance shutter 62 has been forcibly opened by the user's hand in an unauthorized manner, the lower end of discharge duct 61 is moved forward since the balance shutter 62 is pulled downward and forward. As a result, the interlock switch 63 is opened to prohibit the supply of electric power to the geared motor 41. In such a condition, the agitator 30 stops, and accidental injury to the user will be avoided even if the user's hand is inserted into the interior of bin 20 through the delivery chute 23.

When it is desired to clean the delivery chute 23 and discharge mechanism 60, the front panel 10*a* is removed from the front wall of cabinet 10, and the discharge duct 61 is lifted up. Thus, the lateral pins 61*c*, 61*d* of duct 61 are released from the vertical recesses of support flanges 22*b*, 22*c* to remove the discharge duct 61 from the front wall 22 of bin 20. Subsequently, the lateral support rod 62*a* is removed from the side flanges 61*a*, 61*b* of duct 61 after removal of the pin 62*e*. Thus, the delivery chute 23 is exposed to the exterior, and the balance shutter 62 is separated from the discharge duct 61 without using any tools. Additionally, the weight element 62*d* can be removed by hand from the balance shutter 62. In such a condition, the delivery chute 23 and component parts of the discharge mechanism 60 can be cleaned in a simple manner. After cleaning, the component parts of discharge mechanism 60 can be easily reassembled and mounted to the front wall 22 of bin 20 in the opposite sequence to the process of disassembly described above. If the balance shutter 62 or weight element 62*d* is not correctly reassembled, the discharge duct 61 would be inclined forward from the front wall 22 of bin 20 at its lower portion. As a result, the interlock switch 63 is maintained in its open position to prohibit the supply of electric power to the geared motor 41. Accordingly, it will be recognized by the user that the balance shutter 62 or weight element 62*d* was not assembled correctly to the discharge duct 61.

Figure 6:
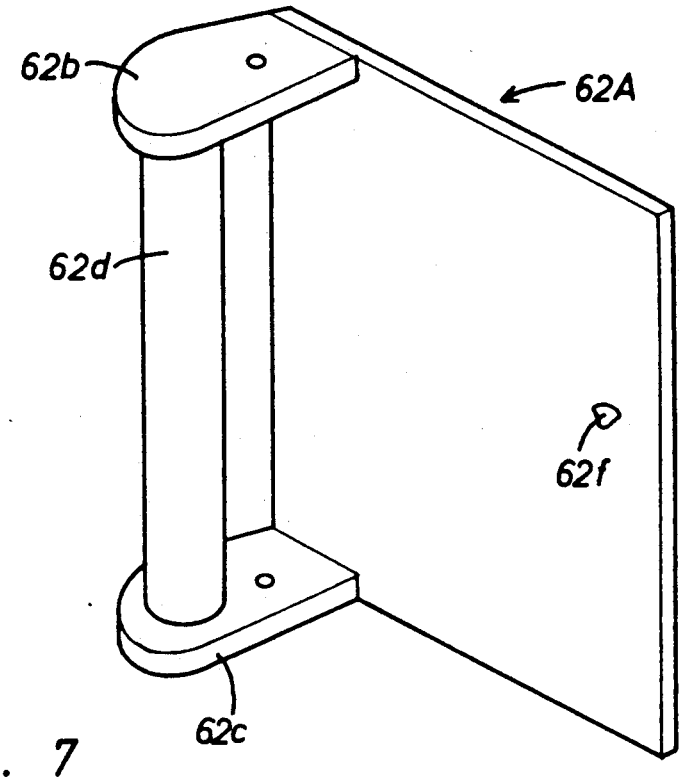
FIG. 6 is a perspective view of a modification of a balance shutter shown in FIGS. 4 and 5.
Figure 7:
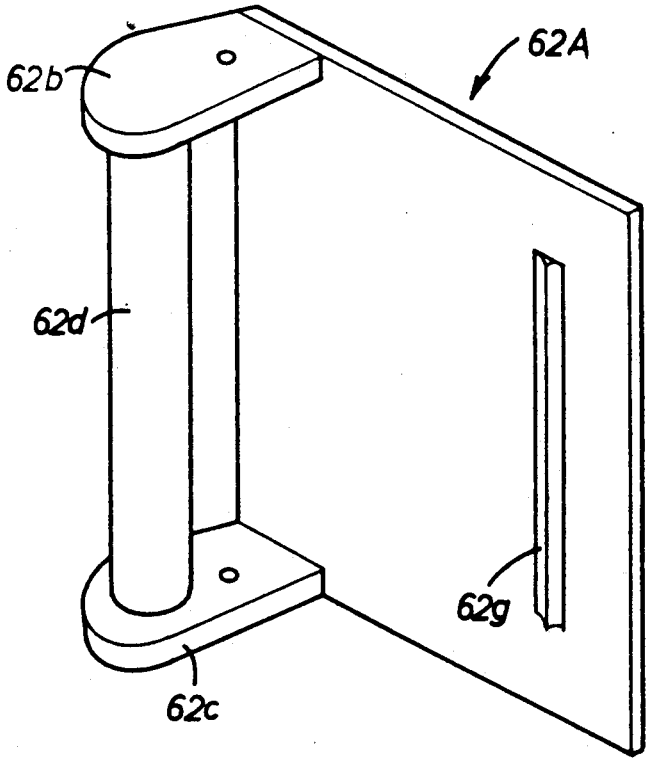
FIG. 7 is a perspective view of another modification of the balance shutter shown in FIGS. 4 and 5.

In the discharge mechanism 60 described above, the balance shutter 62 may be replaced with a modified balance shutter 62A as shown in FIG. 6. The modified balance shutter 62A has a projection 62*f* formed at its bottom surface to be brought into engagement with the internal surface of front wall 61*e* of discharge duct 61 when it has been moved downward to open the discharge duct 61. The projection 62*f* is effective to prevent the balance shutter 62A from adherence to the internal surface of front wall 61*e* of discharge duct 61. Even if the bottom surface of balance shutter 62A or the internal surface of front wall 61*e* is wet with water, the balance shutter 62A will be smoothly returned upward by gravity acting on the weight element 62*d* to close the discharge duct 61. In a practical embodiment of the present invention, the projection 62*f* of shutter 62A may be formed as an elongated ridge 62*g*, triangular in section, as shown in FIG. 7. Alternatively, the projection 62*f* or ridge 62*g* may be formed on the internal surface of the front wall 61*e* of the discharge duct 61.

Although the preferred embodiment and modifications of the present invention have been shown and described, it should be understood that other various modifications and rearrangement of the parts may be resorted to without departing from the scope of the invention as disclosed and claimed herein.

What is claimed is:

1. An ice delivery mechanism in a storage bin-type ice dispenser having a storage bin arranged to store therein an amount of ice cubes, said storage bin having a front wall formed with a dispensing opening at a lower portion thereof, and an agitator rotatably mounted within said storage bin to agitate the ice cubes and discharge them outwardly from said storage bin through the dispensing opening, the ice delivery mechanism comprising:

a tubular delivery chute coupled with the dispensing opening of said storage bin and extending downward and outward from the front wall of said storage bin;

a vertical discharge duct detachably mounted to the lower portion of said front wall and being located just below a lower opening end of said delivery chute to receive the ice cubes discharged therefrom;

a balance shutter tiltably mounted on an upper end of said discharge duct in a detachable manner and extending downward into an interior of said discharge duct for engagement with an internal wall surface of said discharge duct when maintained in a closed position; and a weight element detachably assembled with an outwardly extended portion of said balance shutter to maintain said balance shutter in the closed position by its weight;

wherein said balance shutter is opened by gravity acting on said weight element when the ice cubes from said delivery chute are received thereon.

2. An ice delivery mechanism as claimed in claim 1, wherein said balance shutter is provided at a bottom surface thereof with a projection for engagement with said internal wall surface of said discharge duct.

3. An ice delivery mechanism as claimed in claim 2, wherein the projection of said balance shutter is in a form of an elongated projection which is triangular in section.

4. An ice delivery mechanism as claimed in claim 1, wherein said discharge duct is detachably mounted to the lower portion of said front wall in such a manner as to be vertically positioned in a condition where said weight element has been assembled with the outwardly extended portion of said balance shutter and to be inclined forward when mounted to said front wall of said storage bin without said balance shutter or said weight element, and wherein an interlock switch is mounted to the lower portion of said front wall to be closed by engagement with said discharge duct for permitting power to be supplied to an electric motor in a drive mechanism of said agitator and to be opened for prohibiting the power to be supplied to the electric motor when said discharge duct has been inclined forward.

5. An ice delivery mechanism as claimed in claim 1, further comprising a shutter rotatably mounted to said front wall of said storage bin in a detachable manner to cover said delivery chute when retained in a closed position and to permit the ice cubes dropped from said delivery chute into said discharge duct when moved upward to an open position.

6. An ice delivery mechanism as claimed in claim 1, wherein said balance shutter is integrally formed with a pair of axially spaced arms which are extended outwardly from the upper end of said discharge duct, and said weight element is detachably carried by the arms of said balance shutter.

* * * * *